US010692678B2

(12) United States Patent
Fasano et al.

(10) Patent No.: US 10,692,678 B2
(45) Date of Patent: Jun. 23, 2020

(54) CIRCUIT BREAKER WITH SLIDE TO TEST FUNCTION

(71) Applicant: Carling Technologies, Inc., Plainville, CT (US)

(72) Inventors: Michael Fasano, Watertown, CT (US); James Bugryn, Bristol, CT (US)

(73) Assignee: Carling Technologies, Inc., Plainville, CT (US)

( * ) Notice: Subject to any disclaimer, the term of this patent is extended or adjusted under 35 U.S.C. 154(b) by 148 days.

(21) Appl. No.: 16/123,557

(22) Filed: Sep. 6, 2018

(65) Prior Publication Data

US 2020/0083013 A1 Mar. 12, 2020

(51) Int. Cl.

| | |
|---|---|
| ***H01H 83/04*** | (2006.01) |
| ***H01H 71/52*** | (2006.01) |
| ***H01H 71/02*** | (2006.01) |
| ***H01H 71/08*** | (2006.01) |
| ***H01H 71/46*** | (2006.01) |
| *H01H 83/20* | (2006.01) |

(52) U.S. Cl.

CPC ..... *H01H 83/04* (2013.01); *H01H 71/025* (2013.01); *H01H 71/08* (2013.01); *H01H 71/46* (2013.01); *H01H 71/524* (2013.01); *H01H 2083/201* (2013.01)

(58) Field of Classification Search

CPC .... H01H 71/524; H01H 71/025; H01H 71/08; H01H 71/46; H01H 83/04; H01H 2083/201

See application file for complete search history.

(56) References Cited

U.S. PATENT DOCUMENTS 4,282,500 A * 8/1981 Ducroquet ..... H01H 83/04 335/18
4,288,768 A 9/1981 Amhold et al.
5,457,444 A * 10/1995 Cook ..... H01H 71/04 335/18

(Continued)

FOREIGN PATENT DOCUMENTS

EP 0008026 2/1980
EP 0231732 8/1987

(Continued)

OTHER PUBLICATIONS

EP0008026A1—Electric full-protection circuit breaker—Google Patents translation.*

*Primary Examiner* — Mohamad A Musleh
(74) *Attorney, Agent, or Firm* — Forge IP, PLLC

(57) ABSTRACT

A fault detector test device includes a test switch including a pivotable lever arm having a first end pivotably connected to rotate about an axis and a second end pivotable in an arc around the axis between an active position and an inactive position. A slide member has a first end accessible by an operator and a second end that cooperates with the second end of the lever arm, the slide member being slideable with respect to the axis of the lever arm such that the second end of the slide member slides in a plane that is substantially tangential to the arc in which the second end of the lever arm pivots. The second end of the slide member and the second end of the lever arm cooperate such that generally planar sliding motion of the slide member is translated into pivoting motion of the lever arm.

13 Claims, 4 Drawing Sheets

(56) References Cited

U.S. PATENT DOCUMENTS

| | | | | |
|---|---|---|---|---|
| 2004/0233594 | A1* | 11/2004 | Asano | H01H 71/128<br>361/42 |
| 2006/0274463 | A1* | 12/2006 | Huang | H01H 71/123<br>361/42 |
| 2008/0170341 | A1* | 7/2008 | Huang | H01H 83/04<br>361/42 |

FOREIGN PATENT DOCUMENTS

| | | | | |
|---|---|---|---|---|
| FR | 2500957 | A1 * | 9/1982 | H01H 83/04 |
| GB | 1460310 | A * | 1/1977 | H02H 3/335 |
| GB | 2295275 | | 5/1996 | |

* cited by examiner

CIRCUIT BREAKER WITH SLIDE TO TEST FUNCTION

FIELD OF THE INVENTION

The present invention is generally directed to a circuit breaker device including ground fault circuit interrupter (GFCI) functionality, and more particularly, to such a device that allows for a low profile configuration and/or the positioning of a test actuator button or the like in any of numerous locations on an exterior of the circuit breaker device to allow for flexibility in design of the device.

BACKGROUND OF THE INVENTION

A GFCI is a device that is capable of switching between a tripped (open) and an operative (closed) condition based on the detection of selected criteria. Specifically, a GFCI device is designed to interrupt the supply of electric power when the device detects that current is traveling along an unintended ground path (e.g., through a person, or through water, etc.). GFCI devices may be included in any of numerous types of components that are capable of interrupting the supply of electric power, such as circuit breakers, electrical outlets, etc.

GFCI outlets have become widely used throughout the United States and are credited with saving many lives. Although the widespread use of GFCI devices for the past thirty-plus years has led to a large number of installations, these devices are susceptible to deterioration and eventual failure. Failure of the GFCI device can lead to the device providing electrical power like any normal outlet, even though the protective features that differentiate the GFCI device from conventional devices is no longer functional. This creates a dangerous situation where the GFCI device is still viewed as functional and providing life safety protection when, in fact, it is not.

Typical GFCI devices are provided with a testing feature on the face of the device. For example, on a typical GFCI outlet, there is a "test" button and a "reset" button. When a user pushes the test button, this simulates a problem such that the outlet should toggle to a tripped or open state to interrupt the supply of electrical power to the "load" terminals and to any device plugged into the outlet.

More and more building codes have been requiring that GFCI functionality (as well as arc fault protection) be implemented on the circuit breaker level rather than on the electrical outlet level. This ensures that the whole circuit is protected against ground faults, rather than only that portion of the circuit including and downstream from the GFCI outlet being protected. Thus, GFCI circuit breakers are known and are becoming more and more popular.

Similar to the GFCI outlets, CFCI circuit breakers are provided with a testing feature that simulates a problem such that the breaker should toggle to a tripped or open state to interrupt the supply of electrical power to the circuit. In the case of GFCI circuit breakers, rather than a reset button being provided, the breaker may be reset using a handle or the like. Or if desired, a remote resetting capability may be provided.

A problem exists in the context of GFCI circuit breakers, however, in that the size and or shape of the circuit breaker, or the position of the test actuator button or the like, may be subject to constraint. With GFCI outlets, the test button of generally positioned on the face of the outlet between the two receptacles, and in a vicinity of the printed circuit board (PCB) carrying the GFCI electronics. However, in the case of GFCI circuit breakers, the PCB may be positioned and/or oriented such that locating a traditional push-to-test button may be impracticable.

As such, there remains an unmet need in the industry for a GFCI circuit breaker design that allows for a low profile configuration and/or the positioning of a test actuator button or the like in any of numerous locations on an exterior of the circuit breaker device to allow for flexibility in design of the device.

SUMMARY OF THE INVENTION

In accordance with a first aspect of the present invention, a circuit interrupting device includes a housing, a line terminal disposed on the housing, the line terminal adapted to be connected to a power source circuit to provide electrical power, a load terminal disposed on the housing, the load terminal adapted to be connected to a load circuit, and an interrupter disposed within the housing and electrically coupled between the line terminal and the load terminal, the interrupter having an open and a closed condition, wherein the interrupter electrically connects the line terminal to the load terminal in the closed condition and electrically disconnects the line terminal from the load terminal in the open condition.

A fault detector is configured to detect a fault in an electrical signal in the load circuit, such that when a fault is detected, the interrupter is actuated to the open condition.

A test device is electrically connected to the fault detector and the interrupter, the test device generating a test signal that is adapted to simulate a fault when activated, thereby causing the interrupter to be placed in the open condition. The test device includes a test switch including a pivotable lever arm with a first end pivotably connected to rotate about an axis that is fixed with respect to the housing and a second end that is pivotable in an arc around the axis between an active position and an inactive position, the test device generating the test signal when the second end of the lever arm is actuated to the active position. A slide member has a first end that is accessible by an operator through the housing and a second end that cooperates with the second end of the lever arm, the slide member being slideable with respect to the housing and the axis of the lever arm such that the second end of the slide member slides in a plane that is substantially tangential to the arc in which the second end of the lever arm pivots. The second end of the slide member and the second end of the lever arm cooperate such that generally planar sliding motion of the slide member is translated into pivoting motion of the lever arm about the axis.

In some embodiments, the slide member is moveable from a standard operation position in which the lever arm is in the inactive position to a test position in which the lever arm is caused to pivot to the active position. In certain of these embodiments, the second end of the pivotable lever arm is biased toward the inactive position, such that the slide member is also biased toward the standard operation position.

In some embodiments, the housing has on opening formed therein, and the first end of the slide member has a projection thereon that extends through the opening in the housing.

In some embodiments, the device comprises a circuit breaker, and the device further includes a pair of contacts movable with respect to each other between a closed position wherein the line terminal and the load terminal are in electrical communication with each other, and an open position wherein the line terminal and the load terminal are electrically isolated from each other, and a trip coil connected to at least one of the pair of contacts, the trip coil causing the pair of contacts to move from the closed position to the open position in response to a trip current, thereby tripping the circuit breaker.

In certain of these embodiments, the device further includes a handle extending from a top surface of the housing of the device, the handle adapted to allow for the circuit breaker to be reset from a tripped state to an untripped state. In certain embodiments, the first end of the slide member is accessible through the top surface of the housing of the device. In certain embodiments, the pair of contacts act as the interrupter, such that the circuit breaker is tripped upon activation of the test device.

In some embodiments, the fault in the electrical signal in the load circuit comprises a ground fault.

In accordance with another aspect of the present invention, a fault detector test device is adapted for use with a circuit interrupting device, the test device generating a test signal that is adapted to simulate a fault when activated, thereby causing the circuit interrupting device to interrupt electricity to a load. The test device includes a test switch including a pivotable lever arm with a first end pivotably connected to rotate about an axis and a second end that is pivotable in an arc around the axis between an active position and an inactive position, the test device generating the test signal when the second end of the lever arm is actuated to the active position. A slide member has a first end that is accessible by an operator and a second end that cooperates with the second end of the lever arm, the slide member being slideable with respect to the axis of the lever arm such that the second end of the slide member slides in a plane that is substantially tangential to the arc in which the second end of the lever arm pivots. The second end of the slide member and the second end of the lever arm cooperate such that generally planar sliding motion of the slide member is translated into pivoting motion of the lever arm about the axis.

In some embodiments, the slide member is moveable from a standard operation position in which the lever arm is in the inactive position to a test position in which the lever arm is caused to pivot to the active position. In certain of these embodiments, the second end of the pivotable lever arm is biased toward the inactive position, such that the slide member is also biased toward the standard operation position. In some embodiments, the fault comprises a ground fault.

In accordance with a further aspect of the present invention, a circuit breaker includes a housing, a pair of contacts disposed within the housing and movable with respect to each other between a closed position wherein a line terminal and a load terminal are in electrical communication with each other, and an open position wherein the line terminal and the load terminal are electrically isolated from each other, and a trip coil connected to at least one of the pair of contacts, the trip coil causing the pair of contacts to move from the closed position to the open position in response to a trip current, thereby tripping the circuit breaker. A fault detector is configured to detect a fault in an electrical signal on the load terminal, wherein when a fault is detected the pair of contacts are caused to move from the closed position to the open position, thereby tripping the circuit breaker. A handle extends from a top surface of the housing of the device, the handle adapted to allow for the circuit breaker to be reset from a tripped state to an untripped state.

A test device is electrically connected to the fault detector and the pair of contacts, the test device generating a test signal that is adapted to simulate a fault when activated, thereby causing the pair of contacts to be moved to the open position. The test device includes a test switch having a pivotable lever arm with a first end pivotably connected to rotate about an axis that is fixed with respect to the housing and a second end that is pivotable in an arc around the axis between an active position and an inactive position, the test device generating the test signal when the second end of the lever arm is actuated to the active position. A slide member has a first end that is accessible by an operator through the top surface of the housing and a second end that cooperates with the second end of the lever arm, the slide member being slideable with respect to the housing and the axis of the lever arm such that the second end of the slide member slides in a plane that is substantially tangential to the arc in which the second end of the lever arm pivots. The second end of the slide member and the second end of the lever arm cooperate such that generally planar sliding motion of the slide member is translated into pivoting motion of the lever arm about the axis.

In some embodiments, the slide member is moveable from an standard operation position in which the lever arm is in the inactive position to a test position in which the lever arm is caused to pivot to the active position. In certain of these embodiments, the second end of the pivotable lever arm is biased toward the inactive position, such that the slide member is also biased toward the standard operation position. In certain embodiments, the top surface of the housing has on opening formed therein, and the first end of the slide member has a projection thereon that extends through the opening in the housing. In some embodiments, the fault in the electrical signal on the load terminal comprises a ground fault.

By employing the configuration described herein wherein generally planar sliding motion of a slide member is translated into pivoting motion of a lever arm about an axis rather than employing a push-to-test button mounted directly on a printed circuit board (PCB) carrying the GFCI electronics, the present invention allows for a low profile configuration and also for the positioning of a test actuator slide member (or projection attached thereto) in any of numerous locations on an exterior of the circuit breaker device to allow for great flexibility in design of the device. For example, the area of the slide member actuated by an operator may be spatially separated from the lever arm portion of the switch (which may be mounted on the PCB) by a substantial distance. Additionally, the PCB may be oriented in any of numerous ways with respect to the housing of the device, which may be of particular concern in the context of circuit breakers, which are often subject to rigid size constraints.

Other objects of the invention and its particular features and advantages will become more apparent from consideration of the following drawings and accompanying detailed description.

DETAILED DESCRIPTION OF THE INVENTION

Figure 1:
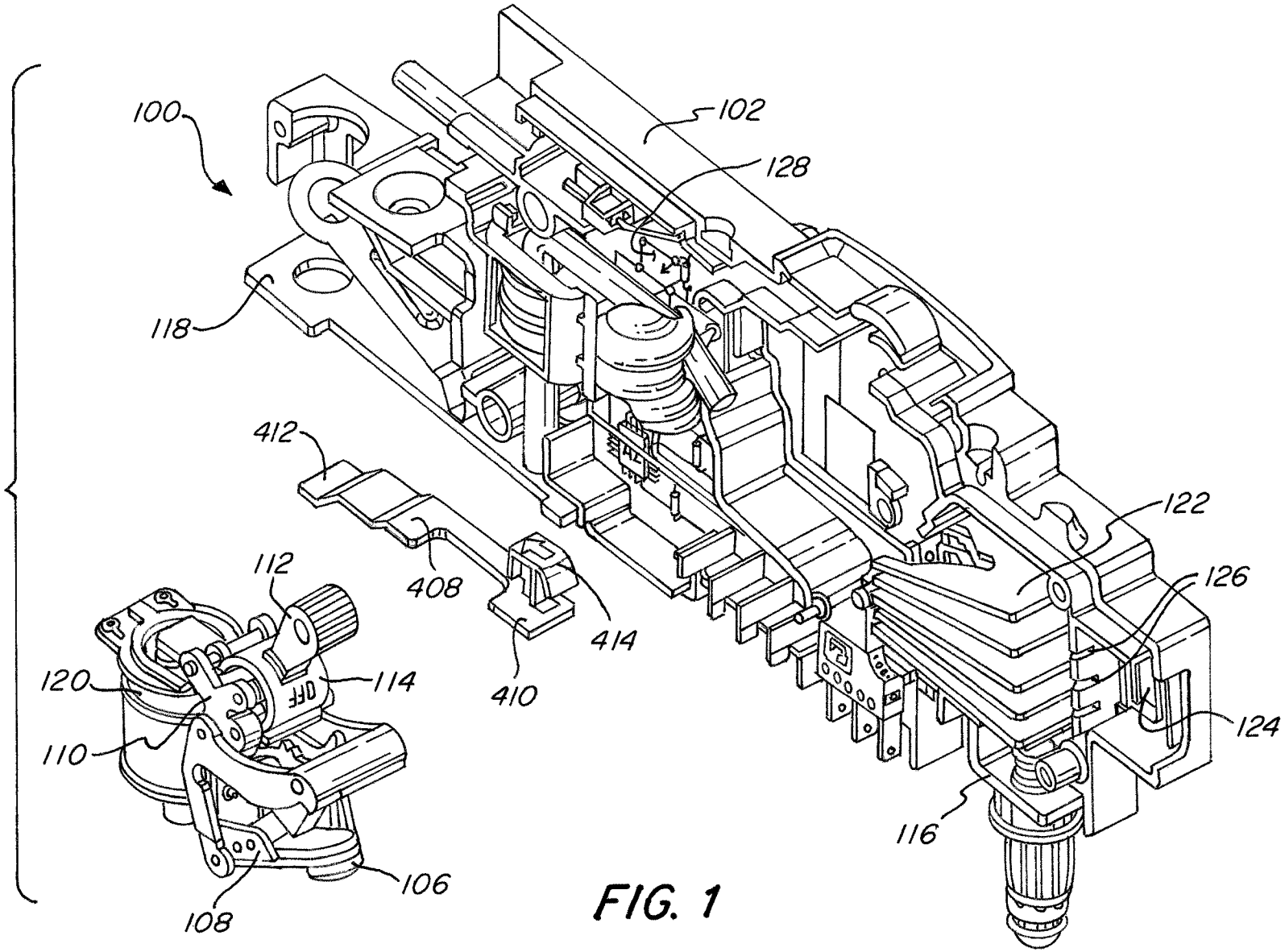
FIG. 1 is a partial exploded isometric view of a circuit breaker including ground fault circuit interrupter (GFCI) functionality and a slide-to-test actuator according to an exemplary embodiment of the present invention.

Referring to the Figures in detail and first to FIG. 1, there is shown an exemplary embodiment of circuit breaker (100) including GFCI functionality in accordance with certain aspects of the present invention.

Circuit breaker (100) is provided with a housing (102) that contains the working elements of the device. The housing (102) is of a "clam-shell" design, with one half of the housing (102) being illustrated in FIGS. 1-3 and with both halves of the housing (102) being illustrated in FIG. 4. The circuit breaker (100) is further provided with a set of contacts including a stationary contact (104) and movable contact (106) (best seen in FIG. 3). The moveable contact (106) is positioned on a moveable contact arm (108).

The moveable contact arm (108) is coupled to a linkage assembly (110), which is in turn, coupled to a handle (114) that includes an elongated portion (112). The moveable contact (106) is configured to move between an open and closed position relative to the stationary contact (104) by manual actuation of the handle (114). The Figures show the contacts (104, 106) in the open position where no electrical current flows therebetween, although one skilled in the art will readily understand how the contacts (104,106) are moved to the closed position.

Also shown in FIG. 1 is a "line" terminal (116), which is adapted to be connected to a source of electrical power, such as a bus bar in a panel board or load center. Stationary contact (104) is mounted onto a plate, which in turn is electrically connected to line terminal (116).

Moveable contact (106) mounted on moveable contact arm (108) is electrically connected to an overcurrent current measurement device, which is likewise connected electrically connected to a "load" terminal (118). The line and load terminals (116,118) may take any of numerous forms depending on the type of panel in which the circuit breaker (100) is adapted to be installed, such as comprising stab connections, screw connections, etc.

In operation, electrical power is input into circuit breaker (100) via line terminal (116), which, when the contacts (104,106) are closed, passes through the current measurement device. If the electrical current exceeds a threshold level, the current measurement device will function to "trip" the circuit breaker (100) by opening the circuit—i.e., opening the contacts (104,106) relative to each other by means of a trip mechanism (120)—such that the flow of electrical current through the contacts (104,106) ceases. In the event that the electrical current does not exceed the threshold level set by the current measurement device, the electrical power is allowed to pass through load terminal (118), which in turn, provides electrical power to the connected circuit and/or equipment.

Figure 2:
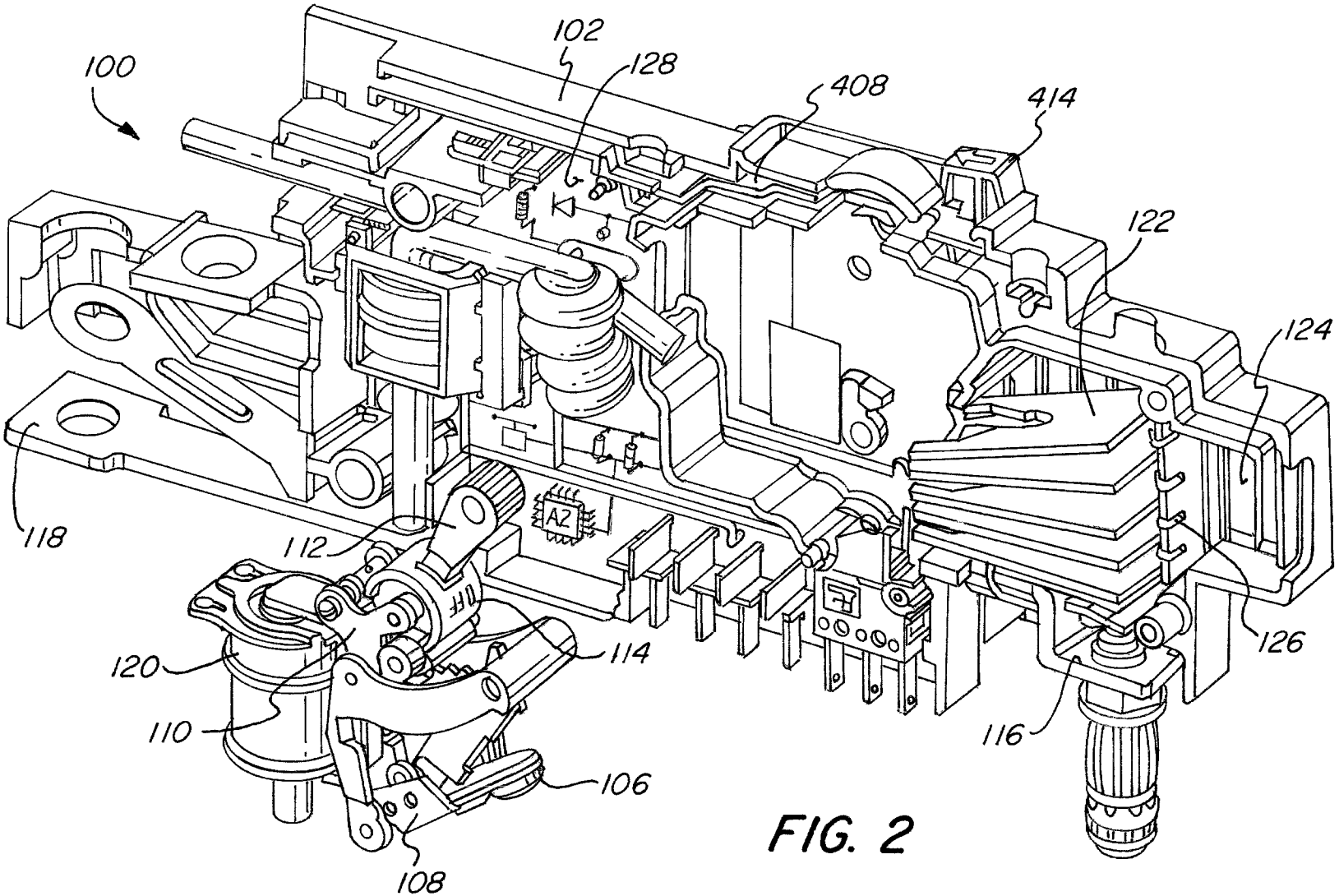
FIG. 2 is a partial exploded isometric view of the circuit breaker of FIG. 1 with the slide-to-test test actuator in position within a housing part of the circuit breaker.

As is shown in FIGS. 1 and 2, the moveable contact arm (108), the moveable contact (106), the linkage (110), the handle (114) and the trip mechanism (120) may be formed as a modular circuit breaker mechanism unit prior to being inserted into the housing for ease of manufacture.

Also illustrated in FIG. 1 is an arc quenching device, which may take the form, for example, of arc plates (122), which are provided to assist in drawing an arc formed between the contacts (104,106) as they are opening or closing away from the contacts (104,106) and in quickly quenching said arc. In one configuration, arc plates (122) are positioned in a radial path that corresponds to the path of movement of the moveable contact (106).

Additionally, a vent (124) may be positioned in the housing (102) in the vicinity of the arc plates (122) so as to allow any gases generated by an arc to exit the housing (102). As can be seen, vent (124) may include a number of openings (126), which are positioned based on the positioning of the arc plates (122).

Figure 3:
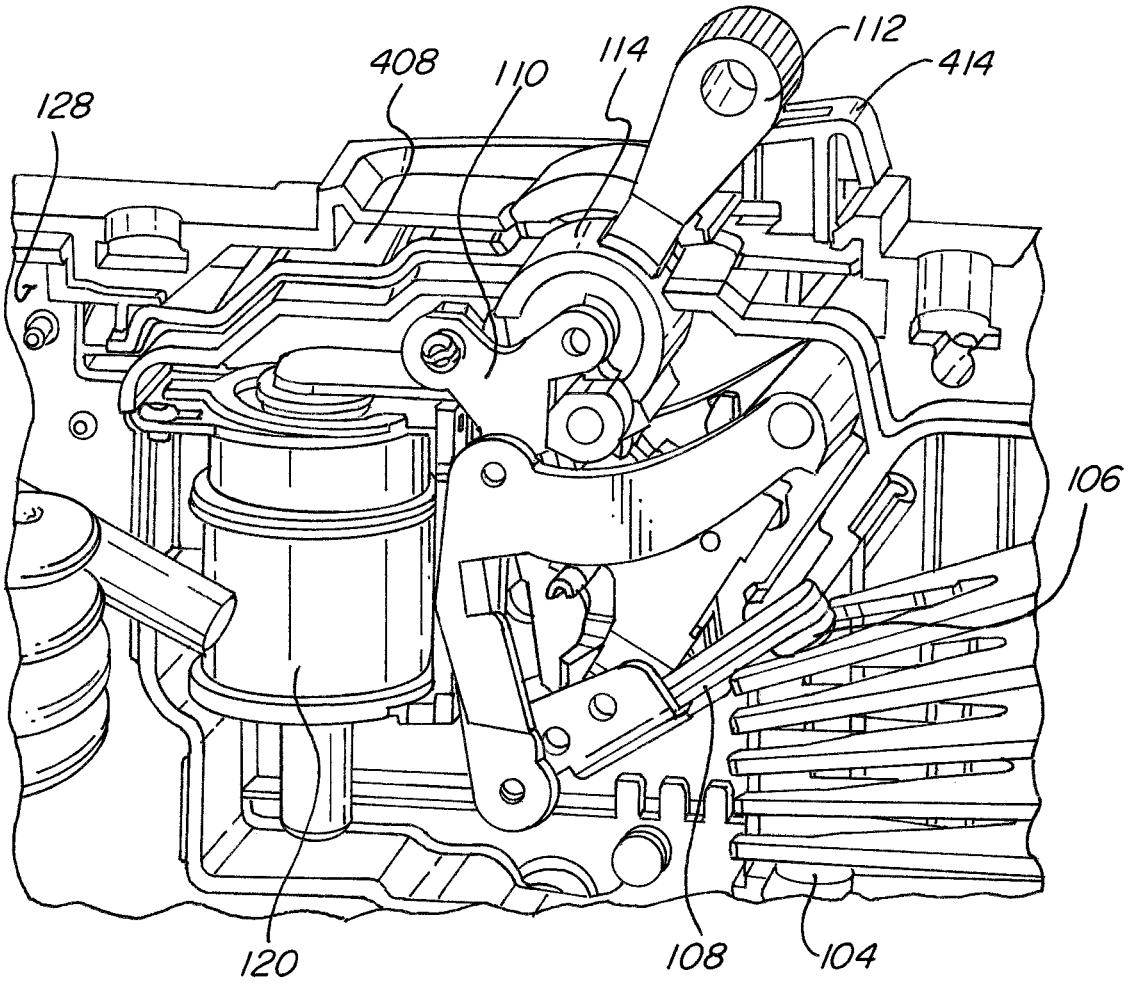
FIG. 3 is a partial isometric view of the slide-to-test test actuator and surrounding components of the circuit breaker of FIG. 1.

The circuit breaker (100) also includes a printed circuit board (PCB) (128), as best seen in FIGS. 2 and 3. The PCB (128) may incorporate thereon the logic necessary to achieve the GFCI functionality of circuit breaker (100), specifically, causing the circuit breaker (100) to terminate the flow of electricity between the line terminal (116) and the load terminal (118) if a threshold level of leakage is sensed.

Leakage is defined as the amount of current imbalance that is measured as a net result of out-bound and returning current from the load side. This would include, for example, measuring the amount of current outbound to one or more devices plugged into the GFCI protected load circuit, and measuring the amount returning on the neutral connection. If there is leakage such that the amount returning is less than the amount out-bound, this difference is the leakage current. A normally operating circuit will have zero current differential (i.e., leakage) when measuring out-bound compared to return current. However, if a threshold level of leakage is sensed (typically between 4 mA and 6 mA), a ground fault condition will be determined to exist, and the GFCI circuitry will cause current to stop flowing.

More specifically, if a ground fault condition is determined to exist, the fault detector circuitry may activate the trip mechanism (120) to cause the contacts (104,106) to open, thereby tripping the circuit breaker (100). Additionally, in some embodiments, the current measurement device (i.e., the overcurrent detector functionality) may also be incorporated in circuitry on the PCB (128), rather than being embodied as a separate and distinct overcurrent detection device.

As is known in the GFCI art, circuit breaker (100) is provided with a testing feature that simulates a ground fault condition such that the GFCI functionality of circuit breaker (100) causes the circuit breaker (100) to terminate the flow of electricity between the line terminal (116) and the load terminal (118). However, rather than employing a typical push-to-test button, the circuit breaker (100) includes a unique arrangement for allowing an operator to activate the testing feature, which testing feature arrangement is defined by two main parts.

Figure 4:
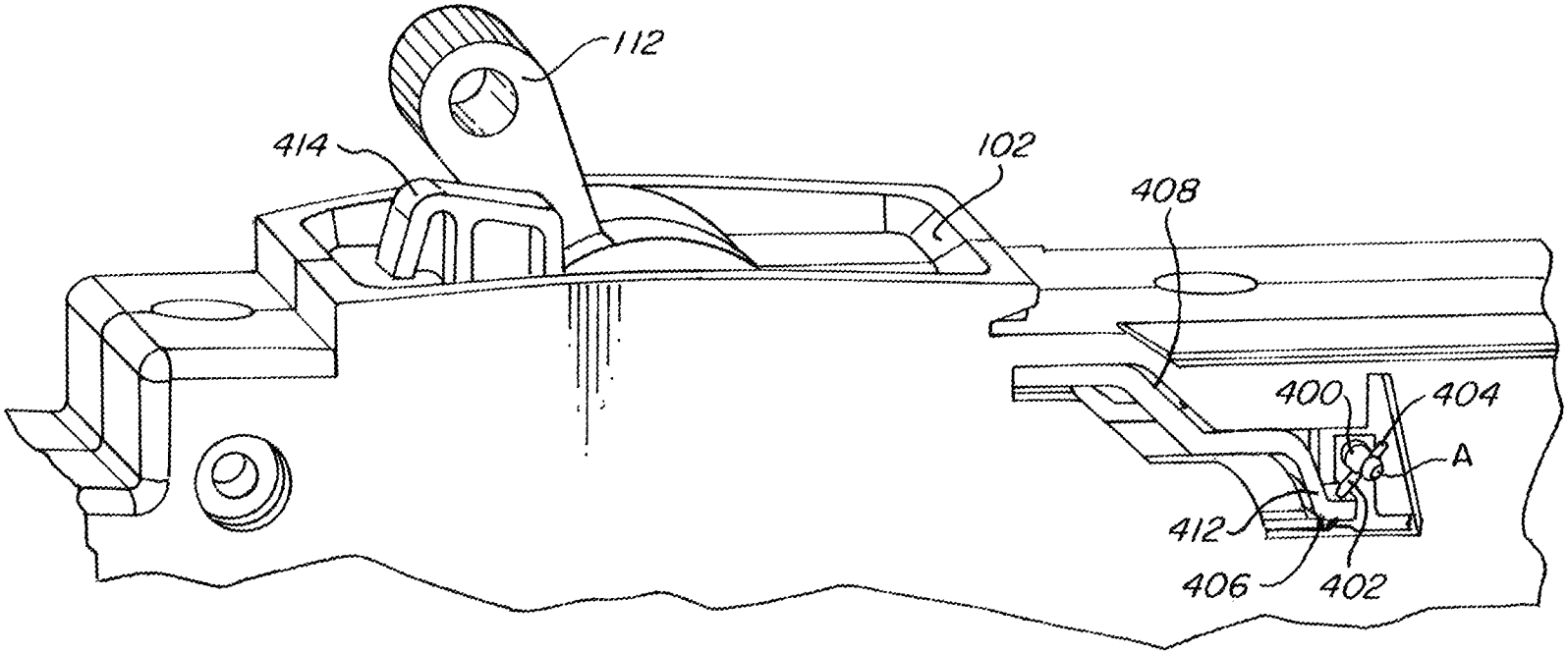
FIG. 4 is an isometric view of an exterior of the assembled circuit breaker of FIG. 1, with portions of the housing cut away to illustrate the configuration of the slide-to-test actuator and surrounding components.

As best seen in FIG. 4, the testing feature employs a test switch (400) including a pivotable lever arm (402) with a first end (404) pivotably connected to rotate about an axis (A) that is fixed with respect to the housing (102) and a second end (406) that is pivotable in an arc around the axis (A) between an active position (not shown) and an inactive position (shown in FIG. 4). The test device generates the test signal when the second end of the lever arm is actuated from the inactive position (shown in FIG. 4) to the active position, which is not shown, but which would involve the lever arm (402) being pivoted in a counter clockwise fashion about axis (A).

The testing feature also employs a slide member (408) having a first end (410) that is accessible by an operator through the housing (102) and a second end (412) that cooperates with the second end (406) of the lever arm (402). The slide member (408) is elongated and may be formed from a generally flat piece of material, such as a polymer. As shown in the Figures, the slide member (408) may include one or more bends and or cut-outs, for example, to accommodate the shape of the housing (102) and/or to avoid interference with other components of the circuit breaker (100).

The slide member (408) is slideable with respect to the housing (408) and the axis (A) of the lever arm (402) such that the second end (412) of the slide member (408) slides in a plane that is substantially tangential to the arc in which the second end (406) of the lever arm (402) pivots. In the embodiment shown in the Figures, the slide member (408) slides in a plane that is generally parallel to a plane in which lies a majority of the top surface of the housing (102).

The second end (412) of the slide member (408) and the second end (406) of the lever arm (402) cooperate such that generally planar sliding motion of the slide member (408) is translated into pivoting motion of the lever arm (402) about the axis (A).

The slide member (408) is moveable from a standard operation position (shown in FIG. 4) in which the lever arm (402) is in the inactive position to a test position (i.e., toward the right with respect to the orientation shown in FIG. 4) in which the lever arm (402) is caused to pivot to the active position (i.e., counterclockwise with respect to the orientation shown in FIG. 4). Preferably, the second end (406) of the pivotable lever arm (402) is biased, for example, by a spring action, toward the inactive position (i.e., clockwise with respect to the orientation shown in FIG. 4), such that the slide member (408) is also biased toward the standard operation position (i.e., toward the left with respect to the orientation shown in FIG. 4).

It is also preferred that the housing (102) has on opening formed therein, and the first end (412) of the slide member (408) has a projection (414) thereon that extends through the opening in the housing (102). The opening is preferably positioned in the top surface of the housing (102), and most preferably in the vicinity of the handle (114), such that the projection (414) of the slide member (408) and the elongated portion (112) of the handle (114) are disposed closely with respect to one another to ensure easy access to both by an operator. This allows for an operator to readily test the GFCI feature of the circuit breaker (100) by actuating the projection (414) of the slide member (408), thereby causing the circuit breaker (100) to trip, and then to reset the circuit breaker (100) by manipulating the elongated portion (112) of the handle (114).

The present invention thus provides a circuit breaker device including GFCI functionality that allows for a low profile configuration and/or the positioning of a test actuator button or the like in any of numerous locations on an exterior of the circuit breaker device to allow for flexibility in design of the device.

What is claimed is:

1. A circuit interrupting device comprising:

a housing;

a handle extending from a top surface of the housing;

a line terminal disposed on the housing, said line terminal adapted to be connected to a power source circuit to provide electrical power;

a load terminal disposed on the housing, said load terminal adapted to be connected to a load circuit;

an interrupter disposed within the housing and electrically coupled between said line terminal and said load terminal, said interrupter having an open and a closed condition, wherein said interrupter electrically connects said line terminal to said load terminal in the closed condition and electrically disconnects said line terminal from said load terminal in the open condition;

a fault detector configured to detect a fault in an electrical signal in said load circuit, wherein when a fault is detected said interrupter is actuated to the open condition; and a test device electrically connected to said fault detector and said interrupter, said test device generating a test signal that is adapted to simulate a fault when activated, thereby causing the interrupter to be placed in the open condition, said test device comprising:

a test switch comprising a pivotable lever arm with a first end pivotably connected to rotate about an axis that is fixed with respect to the housing and a second end that is pivotable in an arc around the axis between an active position and an inactive position, said test device generating the test signal when the second end of the lever arm is actuated to the active position;

a slide member having a first end that is accessible by an operator through the housing and a second end that cooperates with the second end of the lever arm, the slide member being slideable with respect to the housing and the axis of the lever arm such that the second end of the slide member slides in a plane that is substantially tangential to the arc in which the second end of the lever arm pivots;

wherein the first end of the slide member is accessible through the top surface of the housing, and slides in a plane that is generally parallel to a plane in which lies a majority of the top surface of the housing; and wherein the second end of the slide member and the second end of the lever arm cooperate such that generally planar sliding motion of the slide member is translated into pivoting motion of the lever arm about the axis.

2. The circuit interrupting device of claim 1 wherein the slide member is moveable from a standard operation position in which the lever arm is in the inactive position to a test position in which the lever arm is caused to pivot to the active position.

3. The circuit interrupting device of claim 2 wherein the second end of the pivotable lever arm is biased toward the inactive position, such that the slide member is also biased toward the standard operation position.

4. The circuit interrupting device of claim 1 wherein said housing has on opening formed therein, and wherein the first end of the slide member has a projection thereon that extends through the opening in said housing.

5. The circuit interrupting device of claim 1 wherein said device comprises a circuit breaker, and wherein said device further comprises:

a pair of contacts movable with respect to each other between a closed position wherein the line terminal and the load terminal are in electrical communication with each other, and an open position wherein the line terminal and the load terminal are electrically isolated from each other; and a trip coil connected to at least one of said pair of contacts, said trip coil causing said pair of contacts to move from the closed position to the open position in response to a trip current, thereby tripping the circuit breaker.

6. The circuit interrupting device of claim 5 wherein said handle is adapted to allow for the circuit breaker to be reset from a tripped state to an untripped state.

7. The circuit interrupting device of claim 5 wherein the pair of contacts act as said interrupter, such that the circuit breaker is tripped upon activation of the test device.

8. The circuit interrupting device of claim 1 wherein the fault in the electrical signal in said load circuit comprises a ground fault.

9. A circuit breaker comprising:

a housing;

a pair of contacts disposed within said housing and movable with respect to each other between a closed position wherein a line terminal and a load terminal are in electrical communication with each other, and an open position wherein the line terminal and the load terminal are electrically isolated from each other;

a trip coil connected to at least one of said pair of contacts, said trip coil causing said pair of contacts to move from the closed position to the open position in response to a trip current, thereby tripping the circuit breaker;

a fault detector configured to detect a fault in an electrical signal on said load terminal, wherein when a fault is detected said pair of contacts are caused to move from the closed position to the open position, thereby tripping the circuit breaker;

a handle extending from a top surface of the housing of said device, said handle adapted to allow for the circuit breaker to be reset from a tripped state to an untripped state; and a test device electrically connected to said fault detector and said pair of contacts, said test device generating a test signal that is adapted to simulate a fault when activated, thereby causing the pair of contacts to be moved to the open position, said test device comprising:

a test switch comprising a pivotable lever arm with a first end pivotably connected to rotate about an axis that is fixed with respect to the housing and a second end that is pivotable in an arc around the axis between an active position and an inactive position, said test device generating the test signal when the second end of the lever arm is actuated to the active position;

a slide member having a first end that is accessible by an operator through the top surface of the housing and a second end that cooperates with the second end of the lever arm, the slide member being slideable with respect to the housing and the axis of the lever arm such that the second end of the slide member slides in a plane that is substantially tangential to the arc in which the second end of the lever arm pivots;

wherein the first end of the slide member is accessible through the top surface of the housing, and slides in a plane that is generally parallel to a plane in which lies a majority of the top surface of the housing; and wherein the second end of the slide member and the second end of the lever arm cooperate such that generally planar sliding motion of the slide member is translated into pivoting motion of the lever arm about the axis.

10. The circuit breaker of claim 9 wherein the slide member is moveable from a standard operation position in which the lever arm is in the inactive position to a test position in which the lever arm is caused to pivot to the active position.

11. The circuit breaker of claim 10 wherein the second end of the pivotable lever arm is biased toward the inactive position, such that the slide member is also biased toward the standard operation position.

12. The circuit breaker of claim 11 wherein the top surface of said housing has on opening formed therein, and wherein the first end of the slide member has a projection thereon that extends through the opening in said housing.

13. The circuit breaker of claim 9 wherein the fault in the electrical signal on said load terminal comprises a ground fault.

* * * * *